US007665535B2

(12) United States Patent
Van Wulfften Palthe

(10) Patent No.: US 7,665,535 B2
(45) Date of Patent: Feb. 23, 2010

(54) RIGLESS ONE-TRIP SYSTEM AND METHOD

(75) Inventor: Paul J. G. Van Wulfften Palthe, Perth (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 1145 days.

(21) Appl. No.: 10/740,016

(22) Filed: Dec. 18, 2003

(65) Prior Publication Data

US 2004/0129419 A1 Jul. 8, 2004

Related U.S. Application Data

(60) Provisional application No. 60/435,633, filed on Dec. 19, 2002.

(51) Int. Cl.
*E21B 43/04* (2006.01)

(52) U.S. Cl. ..... 166/385; 166/278; 166/297; 166/51; 166/55.1

(58) Field of Classification Search ..... 166/297, 166/278, 385, 51, 55.1
See application file for complete search history.

(56) References Cited

U.S. PATENT DOCUMENTS 5,211,243 A * 5/1993 Strattan et al. ..... 166/374
5,329,998 A * 7/1994 King et al. ..... 166/51
5,901,789 A * 5/1999 Donnelly et al. ..... 166/381
6,199,632 B1 * 3/2001 Shy ..... 166/242.6
6,216,785 B1 * 4/2001 Achee et al. ..... 166/278
6,253,854 B1 * 7/2001 Fenton ..... 166/364
6,286,598 B1 9/2001 Van Petegem et al.
6,325,146 B1 * 12/2001 Ringgenberg et al. .. 166/250.17
6,382,323 B1 * 5/2002 Gano et al. ..... 166/382
6,568,474 B2 * 5/2003 George et al. ..... 166/278
6,675,893 B2 * 1/2004 Lund ..... 166/278

* cited by examiner

*Primary Examiner*—Jennifer H Gay
*Assistant Examiner*—Nicole A Coy
(74) *Attorney, Agent, or Firm*—Rodney Warfford; Jeremy P. Welch; Trop, Pruner & Hu PC

(57) ABSTRACT

A one-trip system for use in a subterranean well includes a tubing hanger, a production tubing, a perforating gun assembly and a screen assembly. The tubing hanger is adapted to be mounted to one of a well in the well casing near the earth's surface. The production tubing is sealingly attached to the tubing hanger, and the perforating gun assembly is coupled to the production tubing. The tubing hanger, production tubing, perforating gun assembly and screen assembly are adapted to be run downhole as a unit. Once the unit is positioned downhole the screen assembly is adapted to be moved relative to the production tubing by a riglessly-deployed continuous medium that is deployed through the production tubing from the surface of the well.

19 Claims, 3 Drawing Sheets

RIGLESS ONE-TRIP SYSTEM AND METHOD

This application claims the benefit of U.S. Provisional Application No. 60/435,633, filed on Dec. 19, 2002.

BACKGROUND OF THE INVENTION

1. Field of Invention

The present invention pertains to systems used to complete subsurface wells, and particularly to systems designed to reduce the number of trips required in and out of the well to complete the well.

2. Related Art

Oil and gas wells are very expensive to drill and complete. A major cost factor is the expense of having a rig at the well site. Significant savings can be realized if the time a rig is needed is minimized.

One way to minimize rig expense is to provide a system that combines various completion operations. Once such a system is placed in the well, the rig can be removed and alternative, cheaper means can be used to operate the completion system. For example, a tubing conveyed perforating assembly may be used in combination with a sand control assembly, or a sand control assembly may be run in with production tubing. Combining originally separate systems reduces the number of required runs.

However, existing combinations still require more than one trip to achieve commonly desired completion objectives. Also, one or more capabilities may be compromised in existing tools. The present invention addresses those issues.

SUMMARY

The present invention provides for a completion system that can be deployed in a single downhole trip, yet still achieve desired completion objectives.

Advantages and other features of the invention will become apparent from the following description, drawings, and claims.

DETAILED DESCRIPTION

Figure 1:
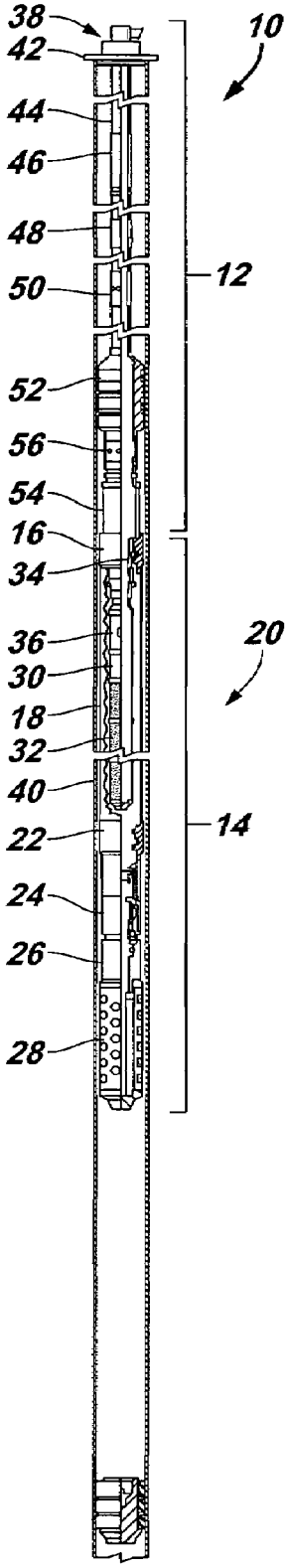
FIG. 1 is a schematic view, with partial cut-away, of a true rigless one-trip system according to an embodiment of the invention.

Referring to FIG. 1, a true rigless one-trip system 10 has, in accordance with an embodiment of the invention, an upper completion assembly 12 and a lower completion assembly 14.

Lower completion assembly 14 comprises a selective nipple 16, a shroud 18, an inner string 20, a no-go nipple 22, a firing head 24, a safety spacer 26, and a perforating gun 28. Lower completion 14 may also include a pupjoint 30. Pupjoints 30 are generally short sections of tubing used to join elements and to attain a desired spacing between those elements.

Selective nipple 16 has a profile that selectively accepts and releasably secures a device having a mating profile while rejecting (i.e., allows to pass) those devices having non-conforming profiles. Selective nipple 16 is used to properly position a device in a wellbore.

Shroud 18 is a pipe that is joined to the lower end of selective nipple 16, but does not engage or otherwise interfere with the profile of selective nipple 16. Shroud 18 initially serves to house and protect inner string 20, which is initially disposed in the tubular interior of shroud 18, and serves as a structural element from which other elements can attach.

Inner string 20 comprises a sand exclusion device or sand screen 32 and a lock 34. Inner string 20 may also include pupjoints 30 or blank pipe (not shown) for spacing, and may optionally include a lower sliding sleeve 36. Though generally referred to herein as sand screen 32, sand exclusion devices 32 include, but are not limited to, wire-wrapped perforated or slotted base pipes, mesh-enclosed perforated or slotted base pipes, and expandable screens such as bi-stable expandable elements. Sand screen 32 has a mating profile to engage the profile of selective nipple 16 and is initially disposed in lower completion assembly 14 with the matching profiles engaged and locked. Lock 34 prevents the unintended release of sand screen 32 from selective nipple 16.

No-go nipple 22 attaches to and extends from the lower end of shroud 18. It has an interior profile like that of selective nipple 16 such that a mating profile such as the profile of sand screen 32 can be secured therein. However, whereas selective nipple 16 will, when lock 34 is not engaged and when sufficient downward force is applied, allow a mating profile to move downward in the wellbore past the profile, no-go nipple 22 will not allow such a mating profile to pass. Thus, no-go nipple 22 establishes a lower limit to which a mating profile such as that of sand screen 32 can travel.

Firing head 24 attaches to the lower end of no-go nipple 22. Firing head 24 can be, for example, hydraulically or mechanically actuated and has an automatic gun release to automatically detach spacer 26 and gun 28 upon detonation of gun 28. Spacer 26 connects at its upper end to the lower end of firing head 24, and at its lower end to the upper end of gun 28. It is notable that gun 28 is not attached to inner string 20, and particularly not attached to sand screen 32. Gun 28 can be, among other choices, a conventional perforating gun or a tubing conveyed perforator.

Upper completion assembly 12 comprises some combination of the following elements. Not all elements will necessarily be present in every possible embodiment because the particular requirements of a particular well may not dictate it. Generally, upper completion 12 comprises all or some of the following structural elements. At or near the earth's surface, a valve 38 is located. Valve 38 is sometimes referred to as a Christmas tree. Immediately below valve 38 and sealingly set in production casing 40 is a tubing hanger 42. Production casing 40 is a type of pipe that is generally cemented in place in the wellbore and, though an integral part of the well completion, is not for our purposes considered part of upper completion 12. Production casing 40 extends from the earth's surface down into the wellbore past the formation that is the zone of interest Upper completion 12 further comprises production tubing 44, sealingly hung from tubing hanger 42. For safety, a surface-controlled subsurface safety valve 46 is placed inline with production tubing 44. If artificial lift is needed, gas lift mandrels 48 with dummy valves can be included and are shown in FIG. 1 some distance below safety valve 46. Other forms of artificial lift can be used such as electrical submersible pumps. Upper sliding sleeves 50 may optionally be included as part of upper completion 12. A production packer 52 attaches inline with production tubing 44 and a gravel pack extension 54 having a gravel packing sliding sleeve 56 may optionally be attached below packer 52. The lowermost element of upper completion 12 connects to the upper end of selective nipple 16.

Figure 2A:
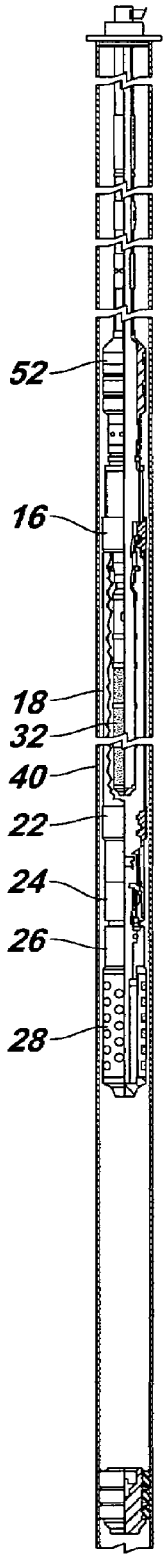
FIGS. 2A-2L are schematic views, with partial cut-away, of the one-trip system of FIG. 1, showing various operational configurations.

In operation, one-trip system 10 is run into the well, as shown in FIG. 2A. Guns 28 are positioned adjacent the formation that is the zone of interest. Multiple guns 28 can be simultaneously run if there are multiple zones of interest. Once one-trip system 10 is in place, the rig can be removed from the well site. The remainder of the completion operations do not require the use of a rig, but instead use a continuous medium such as coiled tubing 58, wireline, or slickline, for example, for mechanical manipulation or fluid transport from the earth's surface.

Figure 2B:
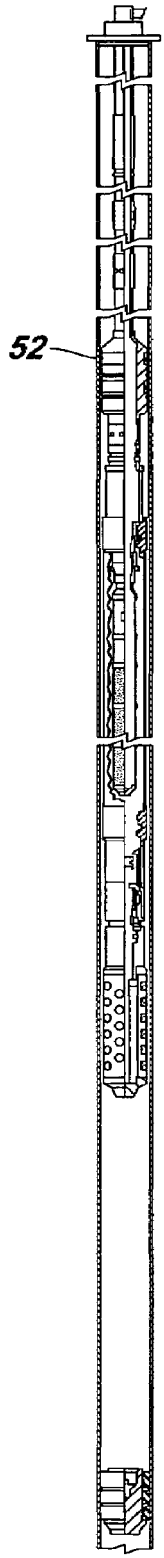
Figure 2C:
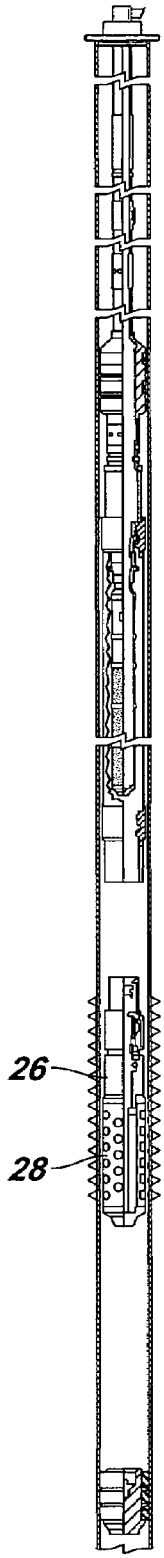

To secure one-trip system 10 in place in the wellbore, packer 52 is actuated and tested for integrity (FIG. 2B). Packer 52 may be actuated by various means, such as hydraulically or mechanically, depending on the packer type. Gun 28 is then fired to perforate production casing 40. Upon firing, gun 28 and spacer 26 disconnect from lower completion assembly 14 and drop to the bottom of the well (FIG. 2C). The well can be perforated in an overbalanced, balanced, or underbalanced condition. Various means can be used to fire gun 28 (e.g., hydraulic, mechanical, or electrical). If necessary, sand screen 32 may be open at its bottom end to allow passage of actuating devices.

Figure 2D:
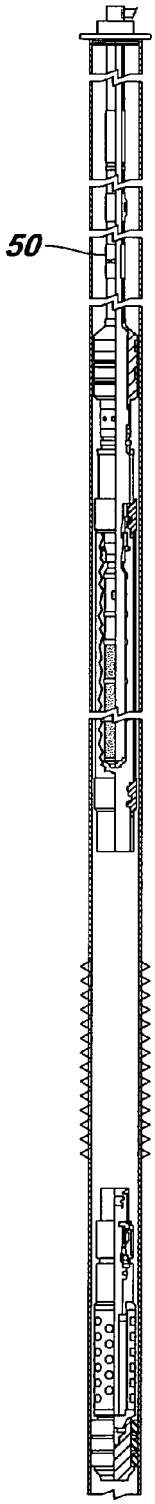
Figure 2E:
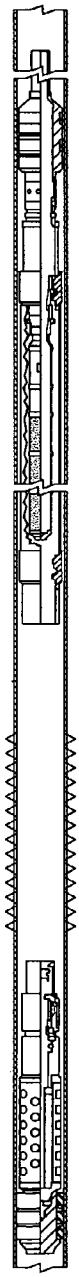
Figure 2F:
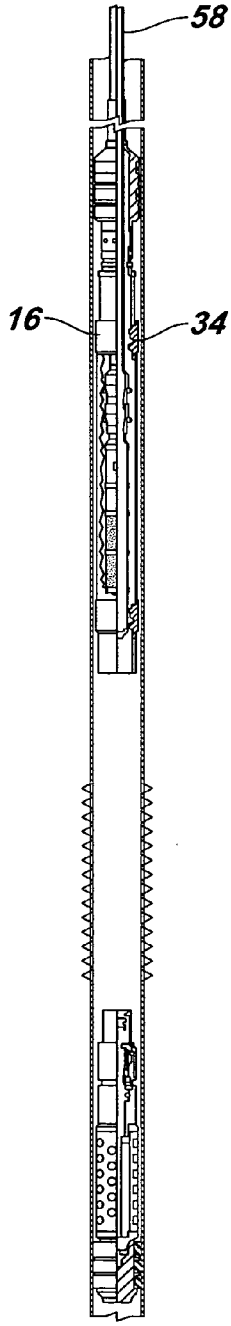
Figure 2G:
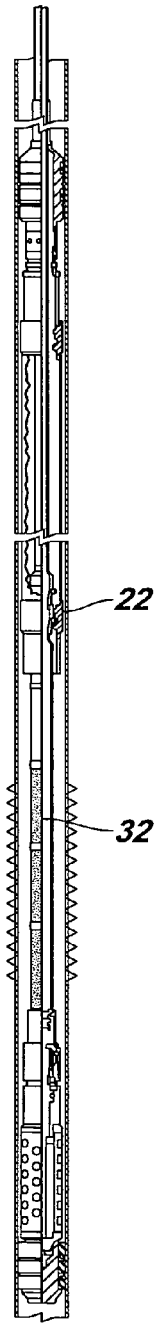
Figure 2H:
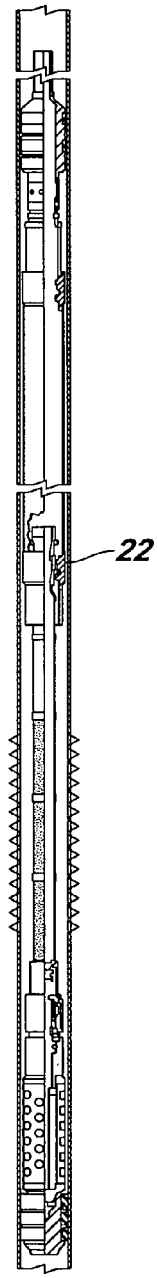

Well fluids can be controlled in different ways. The fluids can be forced back into the formation, or, if available, upper sliding sleeve 50 can be opened to allow circulation using the upper well annulus (FIGS. 2D and 2E). Coiled tubing 58 is then run into the well to engage sand screen 32. Lock 34 is unlocked and sufficient downward force is applied to the coiled tubing 58 to displace sand screen 32 from selective nipple 16 (FIG. 2F). Sand screen 32 is moved until adjacent the perforations made by guns 28 (FIG. 2G). In that position the profile of sand screen 32 mates with the profile of no-go nipple 22. Lock 34 is re-engaged to lock sand screen 32 in place and the coiled tubing 58 is pulled out of the hole (FIG. 2H).

Figure 2I:
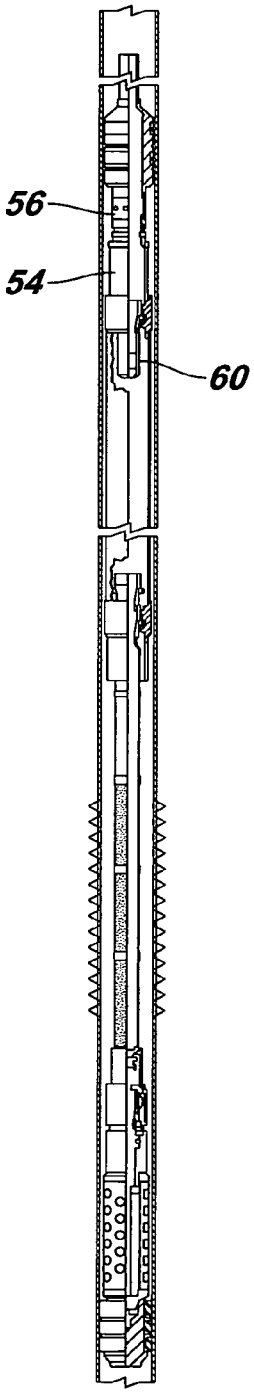
Figure 2J:
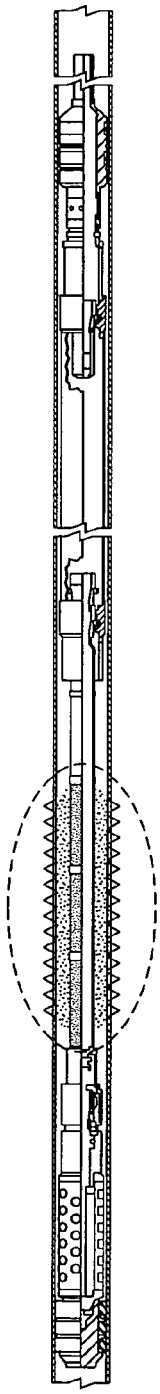
Figure 2K:
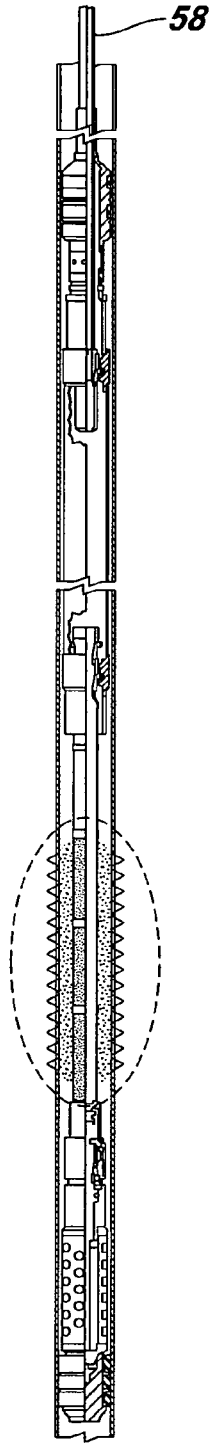
Figure 2L:
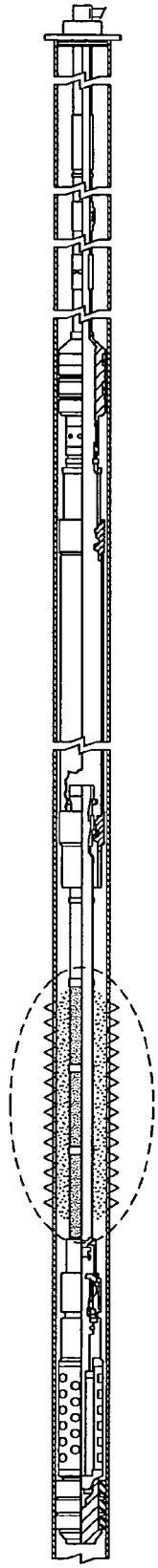

To perform the gravel pack operation, various options are available. In one option, a plug 60 is placed in selective nipple 16 and gravel pack sliding sleeve 56 is opened (FIG. 2I). The sand control treatment fluid ("gravel") can be pumped into the well using either the coiled tubing 58 or production tubing 44. The gravel will exit through ports in extension 54 revealed by the opened sleeve 56. Gravel travels down the annulus and fills the voids around sand screen 32 (FIG. 2J). When the gravel is packed ("screenout"), usually indicated by a sharp rise in pressure, pumping operations can be halted and the coiled tubing 58 can be used to remove any excess sand. As the coiled tubing 58 is pulled out of the hole, plug 60 is removed, gravel pack sliding sleeve 56 is closed (FIG. 2K), and the well is ready to be placed on production (FIG. 2L).

In another option not requiring plug 60 but using lower sliding sleeve 36, gravel is pumped through coiled tubing 58 to pack the space between shroud 18 and sand screen 32, up to the level of lower sleeve 36. Lower sliding sleeve 36 is opened using coiled tubing 58 and gravel is further pumped using either coiled tubing 58 or production tubing 44. Gravel flows through ports exposed by lower sleeve 36 into the well annulus, packing the annulus in the region of shroud 18. As before, once screenout occurs, pumping operations can be halted and the coiled tubing 58 can be used to remove any excess sand. As the coiled tubing 58 is pulled out of the hole, lower sliding sleeve 36 is closed, and the well is ready to be placed online. If artificial lift is necessary, gas lift mandrels 48 (or other lift means) can easily be actuated. Upper sleeve 56 can be opened to allow annular production, if desired.

The operational steps described above vary slightly if sand exclusion device 32 is an expandable screen. Also, the lower portion of the well ("rathole") needs to be extended slightly to accommodate sand accumulation during gravel pack operations. To operate with expandable screen 32, one-trip system 10 is run in place, the rig is removed, packer 52 is set, and gun 28 is fired and dropped, all as before. Then, gravel or fracturing fluid is pumped through coiled tubing 58 or production tubing 44 through the open gravel pack sleeve 56 until screenout occurs. Coiled tubing 58 then latches onto expandable screen 32, dislodges it from selective nipple 16, and moves it downward until it locks into place in no-go nipple 22. Coiled tubing 58 then engages an expander tool (not shown) and forces the expander tool downward, expanding expandable screen 32 radially outward so that expandable screen 32 is pressed against casing 40. Upon reaching the bottom of expandable screen 32, the expander tool can be disengaged from coiled tubing 58 and left in the lower end of expandable screen 32. As coiled tubing 58 is retrieved from the well it can close sleeve 56. Coiled tubing 58 can also open optional valves such as the valves in gas lift mandrel 48 to aid production.

Though the embodiments described refer to sand control techniques, one-trip system 10 may also be used similarly for fracturing operations in which high pressure fluid is injected into the desired subsurface formation and proppants are used to keep the fractures open.

In the preceding description, directional terms, such as "upper," "lower," "vertical," "horizontal," etc., may have been used for reasons of convenience to describe the one-trip system 10 and its associated components. However, such orientations are not needed to practice the invention, and thus, other orientations are possible in other embodiments of the invention.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. §112, paragraph 6 for any limitations of any of the claims herein, except for those in which the claim expressly uses the words 'means for' together with an associated function.

What is claimed is:

1. A one-trip system for use in a subterranean well comprising:

a unit adapted to be run downhole into the well in a single trip, the unit comprising:

a tubing hanger adapted to be mounted to one of the well and a well casing near the earth's surface;

a production tubing sealingly attached to the tubing hanger and adapted to receive a continuous medium riglessly deployed from the earth's surface;

a perforating gun assembly coupled to the production tubing; and a screen assembly adapted to be engaged by the continuous medium to cause the release and movement of the screen assembly relative to the production tubing.

2. The one-trip system of claim 1, further comprising a packer attached to a lower end of the production tubing.

3. The one-trip system of claim 2 further comprising a valve located near the earth's surface and mounted above the tubing hanger to control flow of well fluids.

4. The one-trip system of claim 2, further comprising:

a surface-controlled subsurface safety valve located in-line with the production tubing.

5. The one-trip system of claim 2, further comprising:

an artificial lift device to assist in the production of well fluids.

6. The one-trip system of claim 5, wherein the artificial lift device comprises a gas lift mandrel or an electric submersible pump.

7. The one-trip system of claim 2, further comprising:

an upper sliding sleeve valve mounted in-line with the production tubing above the packer.

8. The one-trip system of claim 2, further comprising an extension having an intermediate sliding sleeve valve mounted below the packer.

9. The one-trip system of claim 1, further comprising:

a selective nipple;

a shroud attached to the selective nipple;

an inner string releasably mounted within an interior of the system; and a no-go nipple mounted to the shroud, wherein a perforating assembly is mounted below the no-go nipple.

10. The one-trip system of claim 9, wherein the perforating assembly includes a perforating gun.

11. The one-trip system of claim 9, wherein the perforating assembly includes a firing head.

12. The one-trip system of claim 9, wherein the perforating assembly includes a safety spacer.

13. The one-trip system of claim 9, further comprising a lock to keep the inner string secured to the selective nipple.

14. The one-trip system of claim 9, wherein the inner string comprises a sand exclusion device.

15. The one-trip system of claim 14, wherein the sand exclusion device comprises a sand screen.

16. The one-trip system of claim 14, wherein the sand exclusion device comprises an expandable element.

17. The one-trip system of claim 9, wherein the inner string is adapted to be moved from a first configuration of being mounted to the selective nipple to a second configuration in which it is mounted to the no-go nipple.

18. The one-trip system of claim 9, wherein the inner string comprises a lower sliding sleeve valve.

19. A method to complete a well in one trip comprising:

placing a one-trip completion system in a desired location in the well using a rig, the one-trip completion system having a perforating gun, a sand screen, and production tubing;

removing the rig;

firing the perforating gun to create perforations in a subsurface formation;

after removal of the rig, running a continuous medium downhole to engage the sand screen and move the sand screen to a position adjacent the perforations;

pumping gravel outside of and around the sand screen; and producing fluids from the well through the production tubing.

* * * * *